US008313350B2

(12) United States Patent
Lee

(10) Patent No.: US 8,313,350 B2
(45) Date of Patent: Nov. 20, 2012

(54) MULTI-FUNCTIONAL WIRING PLUG CONVERTER

(75) Inventor: Chiu-San Lee, New Taipei (TW)

(73) Assignee: XYZ Science Co., Ltd., New Taipei (TW)

( * ) Notice: Subject to any disclaimer, the term of this patent is extended or adjusted under 35 U.S.C. 154(b) by 91 days.

(21) Appl. No.: 13/069,415

(22) Filed: Mar. 23, 2011

(65) Prior Publication Data

US 2012/0171902 A1 Jul. 5, 2012

(30) Foreign Application Priority Data

Jan. 5, 2011 (TW) ..... 100100280 A

(51) Int. Cl.
*H01R 31/00* (2006.01)

(52) U.S. Cl. ..... 439/651; 439/172; 439/222

(58) Field of Classification Search ..... 439/660, 439/651, 682, 217, 218, 221, 170–175, 189
See application file for complete search history.

(56) References Cited

U.S. PATENT DOCUMENTS 5,697,806 A * 12/1997 Whiteman et al. ..... 439/651
5,848,907 A * 12/1998 Chen ..... 439/172
6,328,581 B1 * 12/2001 Lee et al. ..... 439/171
6,330,144 B1 * 12/2001 Lee et al. ..... 439/651
7,794,283 B2 * 9/2010 Wang ..... 439/651
2004/0253854 A1 * 12/2004 Lee et al. ..... 439/106

* cited by examiner

*Primary Examiner* — Felix O Figueroa
(74) *Attorney, Agent, or Firm* — Leong C. Lei

(57) ABSTRACT

A multi-functional wiring plug converter is provided. The converter is mainly composed of a case, connection guiding assemblies and a panel cover. A plurality of setting areas defined by the case are respectively used for installing and fixing the connection guiding assemblies, and each connection guiding assembly is composed of a connection guiding seat, a connection guiding clamp sheet and a wire-locking fixed block. A blocking portion extending from the connection guiding seat forms a plurality of fixed portions, and each fixed portion is used for fixing the connection guiding clamp sheet and the wire-locking fixed block. Therefore, when a power wire needs to be connected, it can be directly locked onto the wire-locking fixed block so that the power wire is fixed in the converter, and the converter can be sold to any region and additionally provided with a connection guiding panel which conforms to specifications of the region. In this way, the commonality of the converter is improved greatly, and meanwhile manufacturers can apply the converter to a socket of any specification, thus causing no storage pressure.

9 Claims, 8 Drawing Sheets

MULTI-FUNCTIONAL WIRING PLUG CONVERTER

BACKGROUND OF THE INVENTION

1. Technical Field of the Invention

The present invention relates to a converter, and more particularly relates to a multi-functional wiring plug converter which can work in the form of a single converter, conform to plug specifications of all nations in the world, and function as a plug of any electrical product.

2. Description of the Prior Art

As the world goes for the target of economic development nowadays, manufacturers of all nations in the world devote themselves to the development of products with interoperability, and in particular, products with high compatibility need to be further developed for the power wire outfits applied in various electrical appliance products. However, the shapes of plugs matching with power wires have been stereotyped and limited, and thus plugs applied in various products must be designed with various specifications so as to mate with sockets of all nations in the world. This does not cause too much storage pressure to manufacturers who are financially sound. On the contrary, as for ordinary small-size and medium-size or lower-level and middle-level manufacturers, in order to promote their merchandise to all nations in the world, they must keep plugs of various different specifications in storage by themselves, thus causing stock and storage pressure. Power wires used by all nations in the world are provided with plugs of different shapes and specifications, for example, wires of American specification, wires of British specification, wires of German and French specification, wires of Italian specification, wires of Swiss specification, wires of Danish specification, wires of Indian specification, wires of South African specification, wires of Israeli specification, wires of Australian specification and so on. More particularly, household power plugs of American specification and Japanese specification have three different specifications, and there will be 12 different specifications plus the other 9 specifications. The above description only relates to power wires for an earthed plug attached to household electrical appliances, but plugs of other merchandise and types are also widely used, thus increasing the storage pressure of manufacturers. If the purchase orders of power wires for plugs are few, the wire production for manufacturing of power wire plugs and injection molding is small, thus increasing the cost.

SUMMARY OF THE INVENTION

A primary objective of the present invention is to provide a multi-functional wiring plug converter which can work in the form of a single converter, conform to plug specifications of all nations in the world, and function as a plug of any electrical product.

A secondary objective of the present invention is to lock power wires onto the converter and additionally provide a connection guiding panel which conforms to specifications of the corresponding nations where the converter is sold.

Another objective of the present invention is that, if electrical appliance products in a mobile type are required, 120V-240V input voltages and a 5V output voltage can be received and different plugs can be mated.

Another objective of the present invention is to meet requirements for plugs that can be conveniently sold and maintained or used under different specifications by importers and exporters.

Another objective of the present invention is to form a plurality of panel covers corresponding to each connection guiding clamp sheet so that the converter functions as a socket into which other plugs are inserted.

A further objective of the present invention is that the converter can be used to charge electrical appliances when a user travels abroad.

DETAILED DESCRIPTION OF THE PREFERRED EMBODIMENTS

Figure 1:
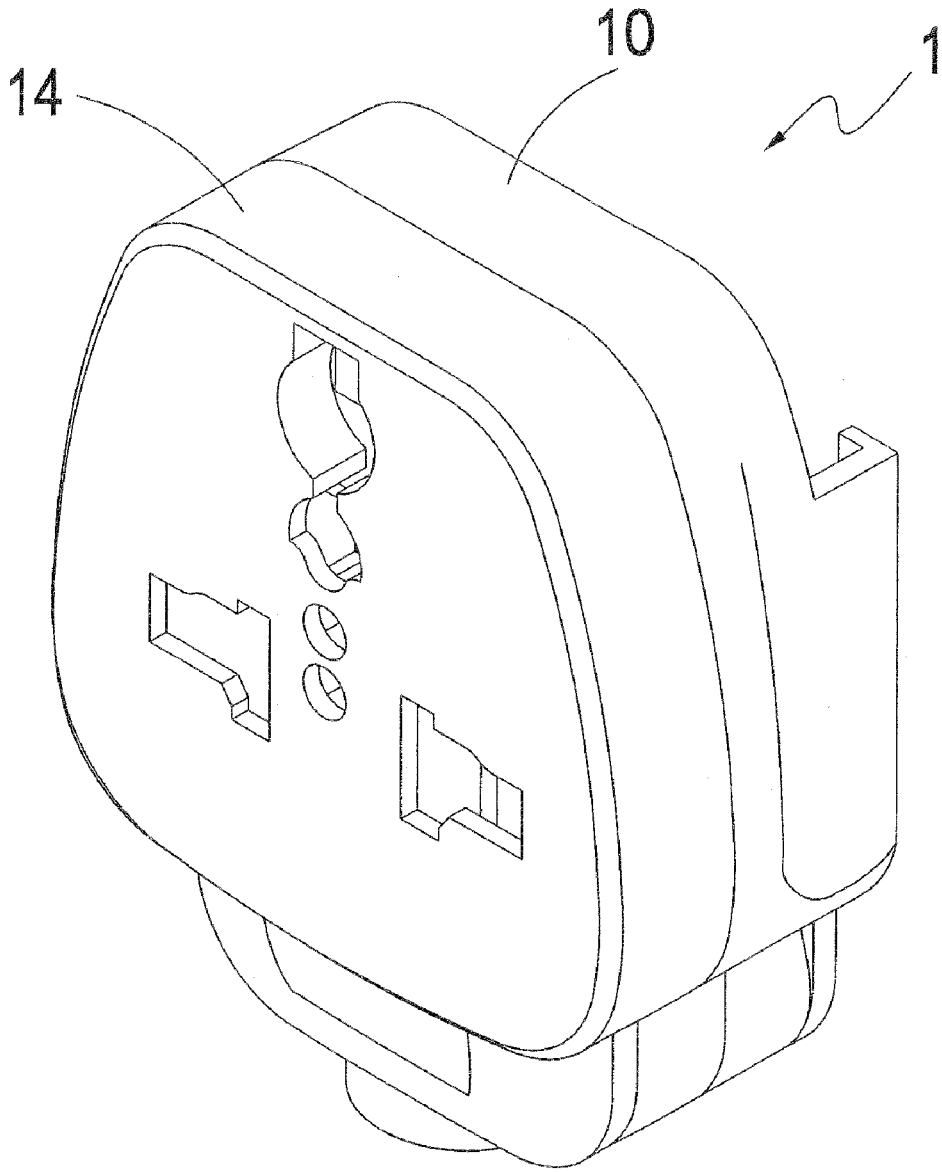
FIG. 1 is a perspective view of a preferred embodiment of the present invention.
Figure 2:
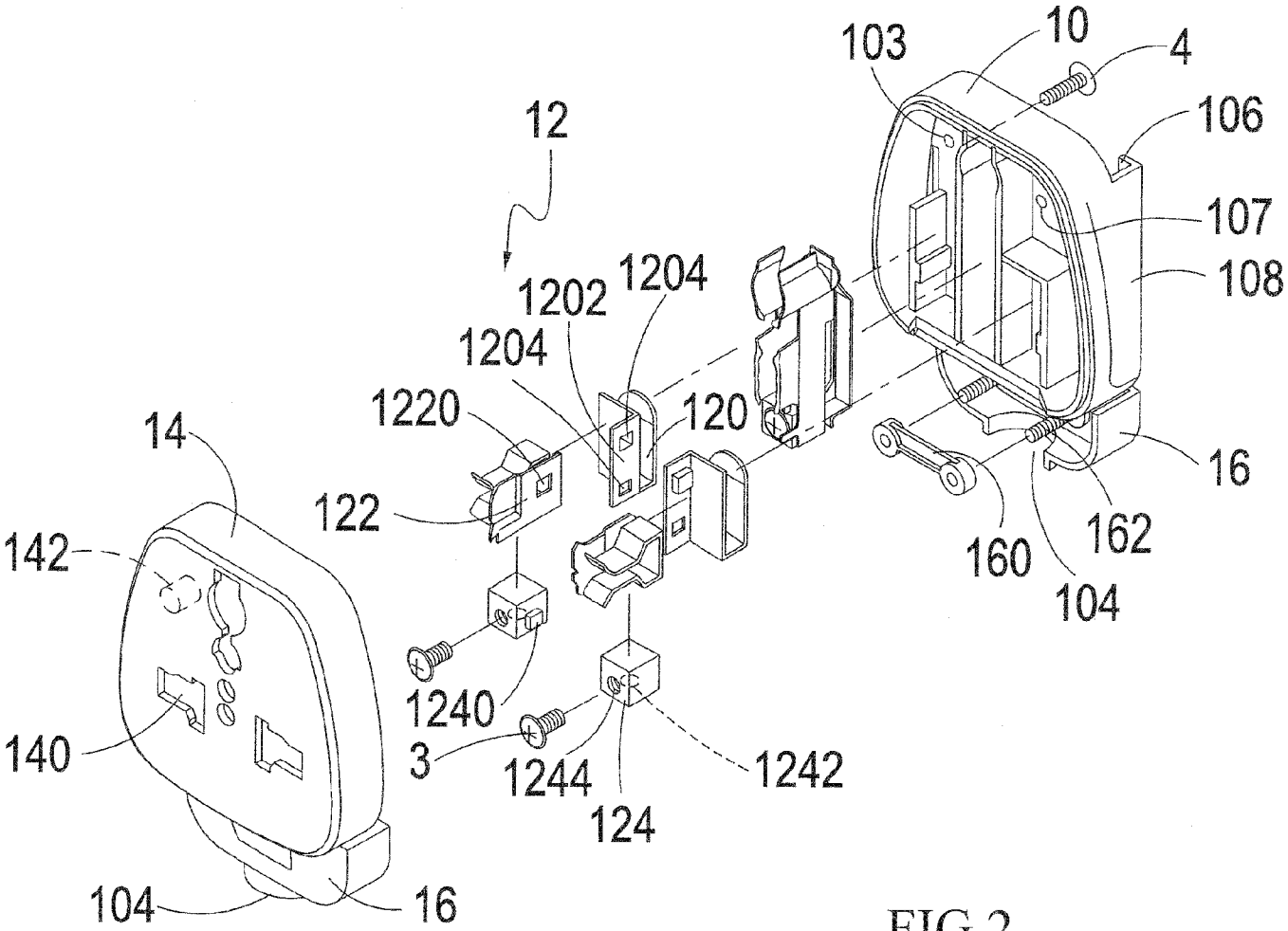
FIG. 2 is an exploded perspective view of a preferred embodiment of the present invention.
Figure 3:
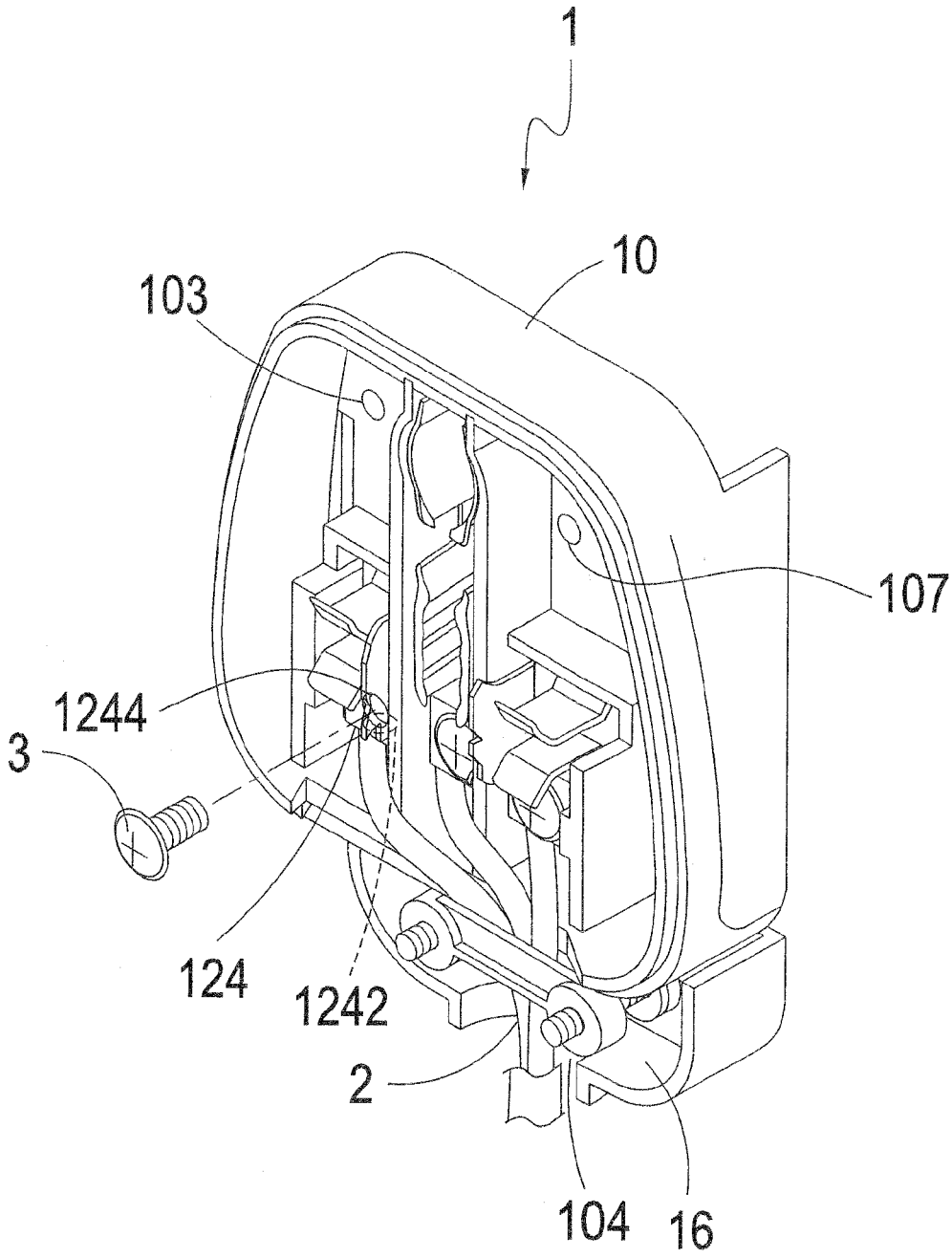
FIG. 3 is a schematic view of internal assembling when connecting a power wire according to the present invention.
Figure 4:
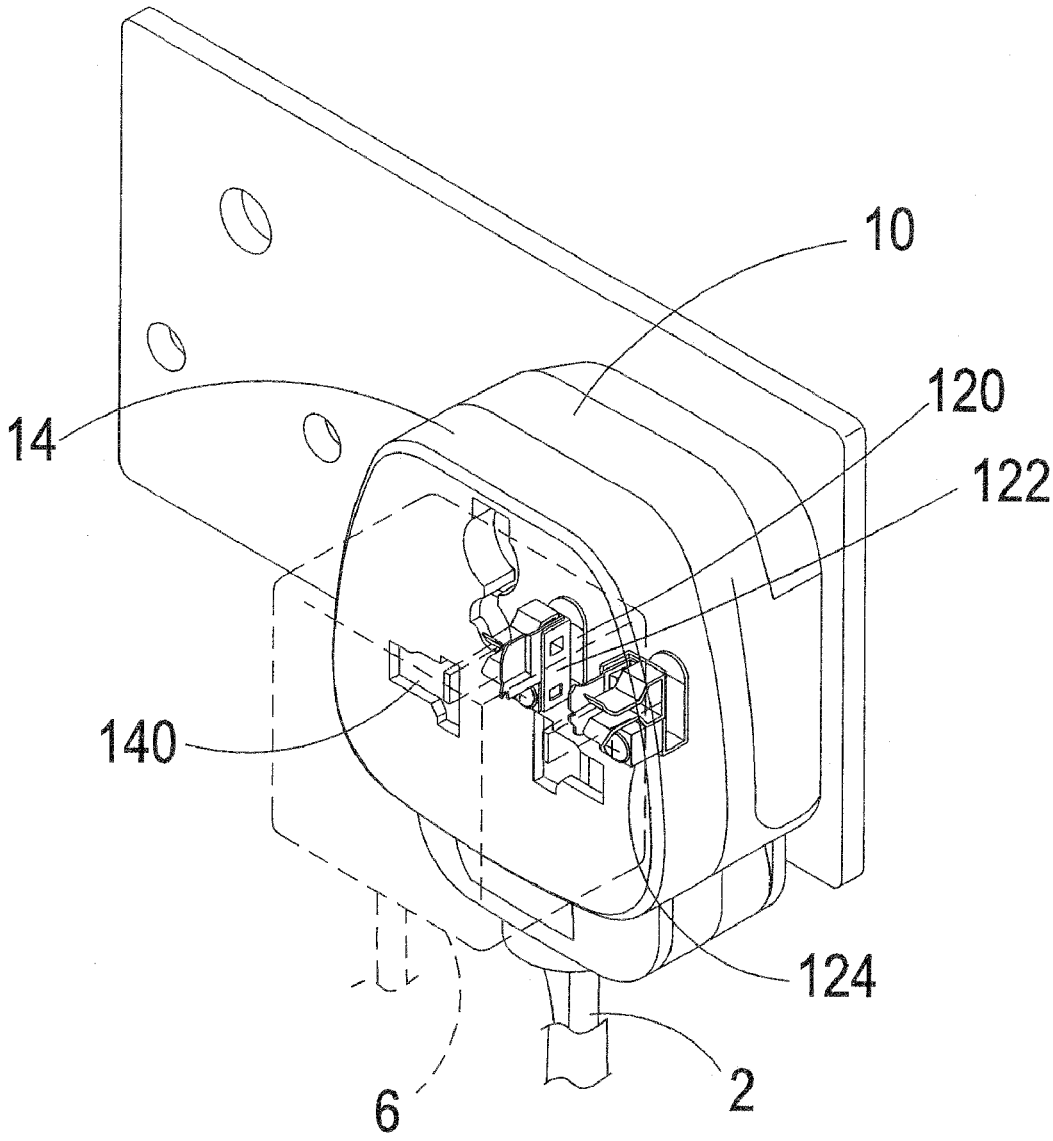
FIG. 4 is a schematic view of joining a panel cover having an insertion hole according to the present invention.

Refer to FIG. 1 and FIG. 2, which are a perspective view and a perspective exploded view of a preferred embodiment of the present invention. As can be clearly seen from the figures, the present invention is a multi-functional wiring plug converter. This converter 1 is mainly composed of a case 10, connection guiding assemblies 12 and a panel cover 14, wherein a plurality of setting areas 102 defined by the case 10 are respectively used for installing and fixing the connection guiding assemblies 12. Each connection guiding assembly 12 is composed of a connection guiding seat 120, a connection guiding clamp sheet 122 and a wire-locking fixed block 124. A blocking portion 1202 extending from the connection guiding seat 120 forms a plurality of fixed portions 1204, and each fixed portion 1204 is used for fixing the connection guiding clamp sheet 122 having a fixed member 1220 and the wire-locking fixed block 124 having a connecting member 1240. Moreover, the wire-locking fixed block 124 is provided with a through hole 1242, through which a power wire 2 passes, and a locking hole 1244, which communicates with the through hole 1242 and is used for screwing a locking member 3 so as to exert a force to fix the power wire.

Figure 5:
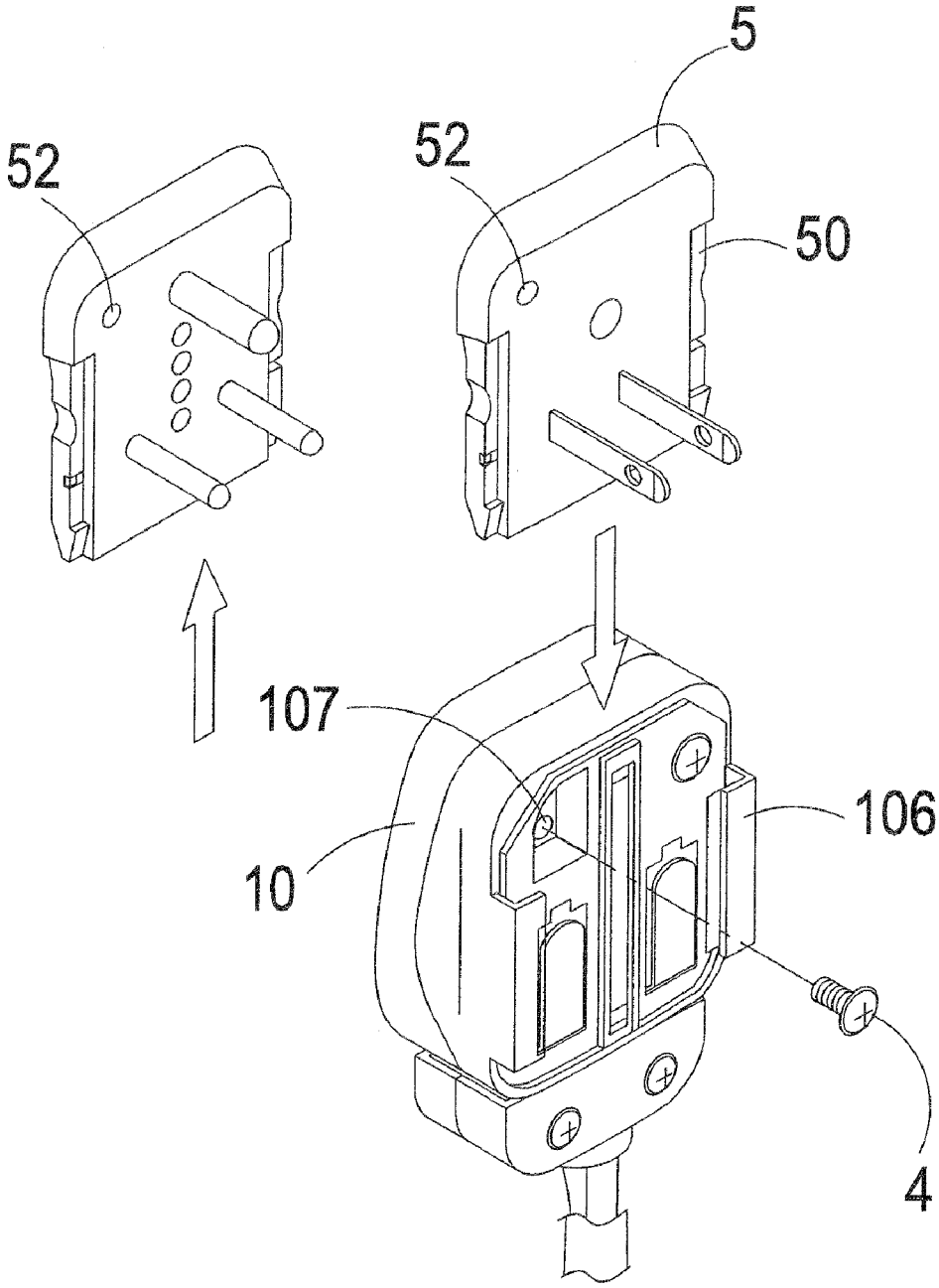
FIG. 5 is a schematic view of joining a replaceable connection guiding panel according to the present invention.
Figure 6:
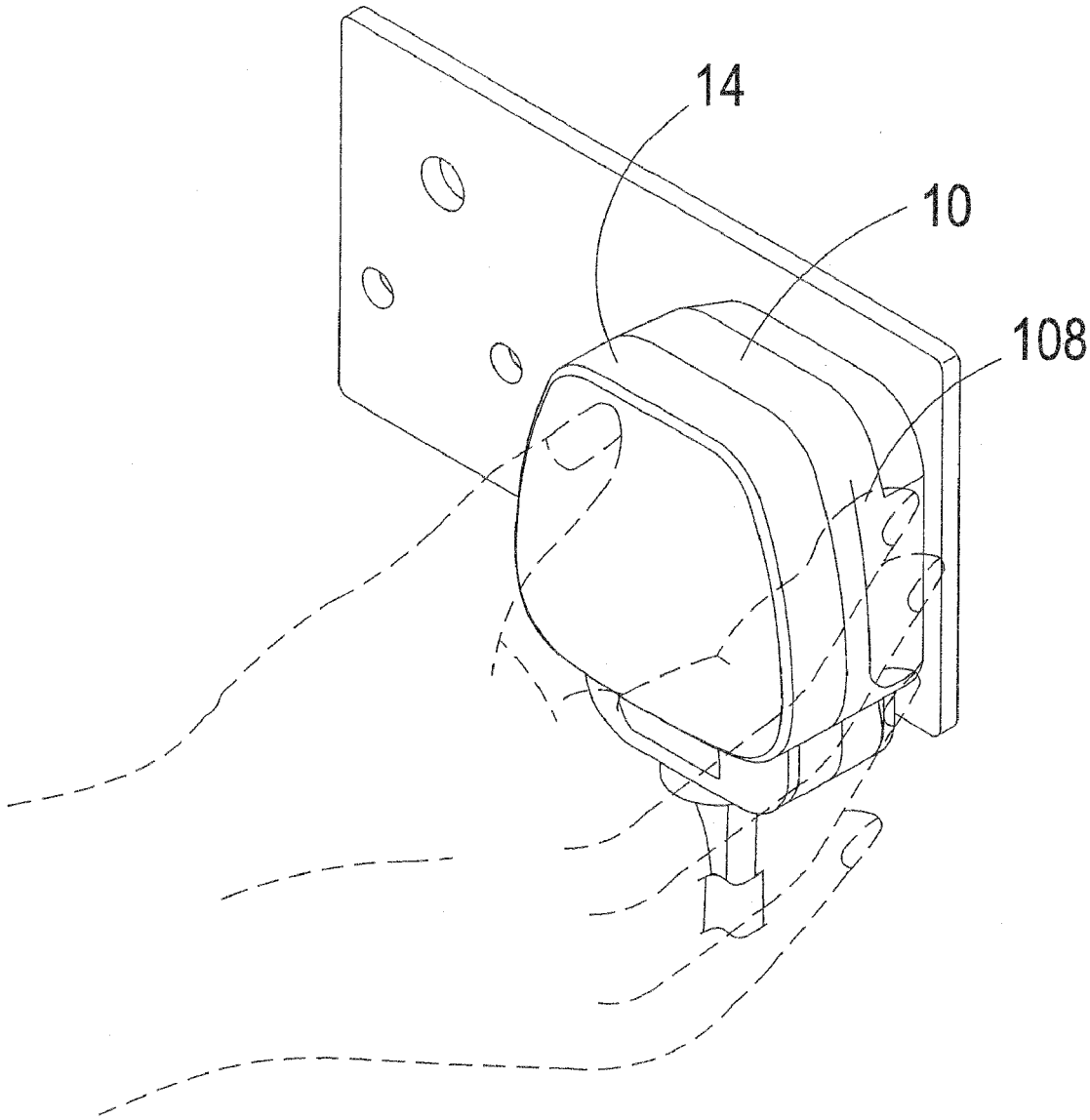
FIG. 6 is a schematic view of insertion and pullout by using a gripping portion on the case according to the present invention.

The case 10 described above is joined and locked onto a hole portion 142 on the panel cover 14 by use of a screw 4 passing through a screw hole 103, and this panel cover 14 forms a plurality of insertion holes 140 corresponding to each connection guiding clamp sheet 122. In addition, a screw connection hole 107 is further disposed on the case 10 to lock a connection guiding panel 5 (refer to FIG. 5), and this panel cover 14 may also be a blank cover. The case 10 described above is joined to a wire-clamp fixed seat 16, and a wire clamp sheet 160 on the wire-clamp fixed seat 16 and a screw 162 locked onto the wire clamp sheet 160 are used to clamp the power wire. Moreover, a perforation portion 104 through which the power wire passes is formed on the case 10. Similarly, a plurality of sliding grooves 106 are formed on the case 10, and a gripping portion 108 used to be gripped for insertion and pullout is formed on an external wall surface of the case 10.

Refer to FIG. 3, FIG. 4, FIG. 5 and FIG. 6, which are a schematic view of internal assembling when connecting a power wire, a schematic view of joining a panel cover having an insertion hole, a schematic view of joining a replaceable connection guiding panel and a schematic view of insertion and pullout by using a gripping portion on the case, according to the present invention. As can be clearly seen from the figures, since the converter 1 is mainly composed of the case 10, the connection guiding assemblies 12 and the panel cover 14, the converter 1 can be applied in any way to any products that need to be connected to household electricity and can conform to plug specifications of household electricity of all nations in the world. First of all, the power wire 2 is inserted into the through hole 1242 on the wire-locking fixed block 124, and after the power wire 2 is completely inserted, the locking member 3 is screwed through the locking hole 1244 to exert a force to fix the power wire 2. After the conductive connection of the power wire 2 is completed, the power wire 2 is clamped by the wire-clamp fixed seat 16 on the case 10 described above and positioned by the perforation portion 104. After the joining, clamping and positioning of the power wire 2 are completed, the panel cover 14 can be joined onto the case 10, and the case 10 is joined and screwed to the hole portion 142 on the panel cover 14 by use of the screw 4 passing through the screw hole 103. In addition, since the insertion holes 140 on the panel cover 14 correspond to each connection guiding clamp sheet 122, a user can insert other types of plugs 6 having conductive pins into each connection guiding clamp sheet 122 through the insertion holes 140. Since the connection guiding clamp sheet 122, the connection guiding seat 120 and the wire-locking fixed block 124 form a conductive loop, the electricity can pass through the connection guiding clamp sheet 122 to other plugs 6.

Furthermore, the sliding grooves 106 on the case 10 are used to achieve the effect that the connection guiding panel 5 slides through the joining of the position limiting sheets 50 and the sliding grooves 106. Also, the screw 4 passes through the screw connection hole 107 on the case 10 so as to be locked into a screw hole 52 formed on the connection guiding panel 5. Therefore, manufacturers only need to store the connection guiding panel 5 which conforms to socket specifications of all nations in the world, and can directly replace the converter 1, thus decreasing the overall storage pressure relatively.

Moreover, the gripping portion 108 formed on the external wall surface of the case 10 is in a cambered form, and the portion where a force is applied is located on the case 10 itself rather than on the panel cover 14. Therefore, when insertion or pullout is conducted, the panel cover 14 is not pulled open.

Figure 7:
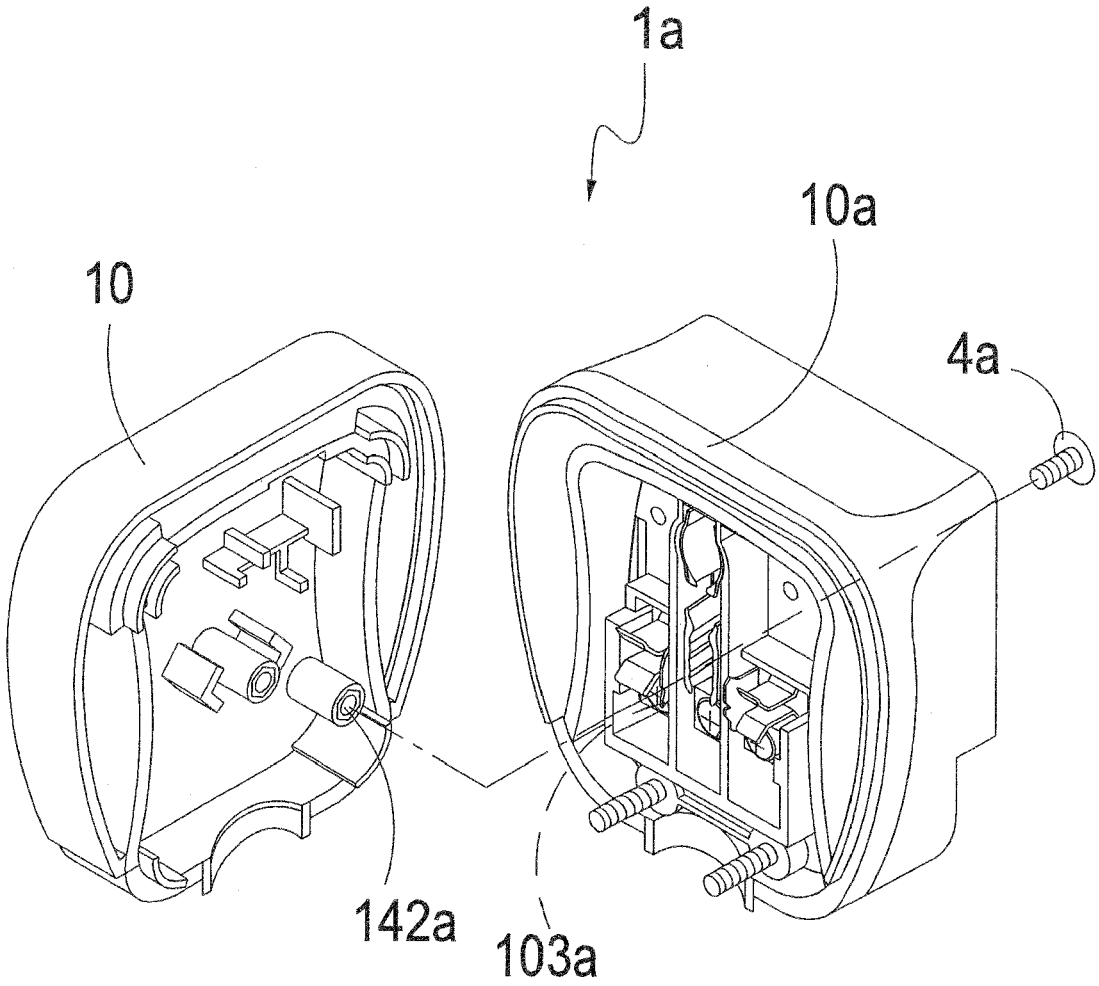
FIG. 7 is a first schematic structural view of another preferred embodiment of the present invention.
Figure 8:
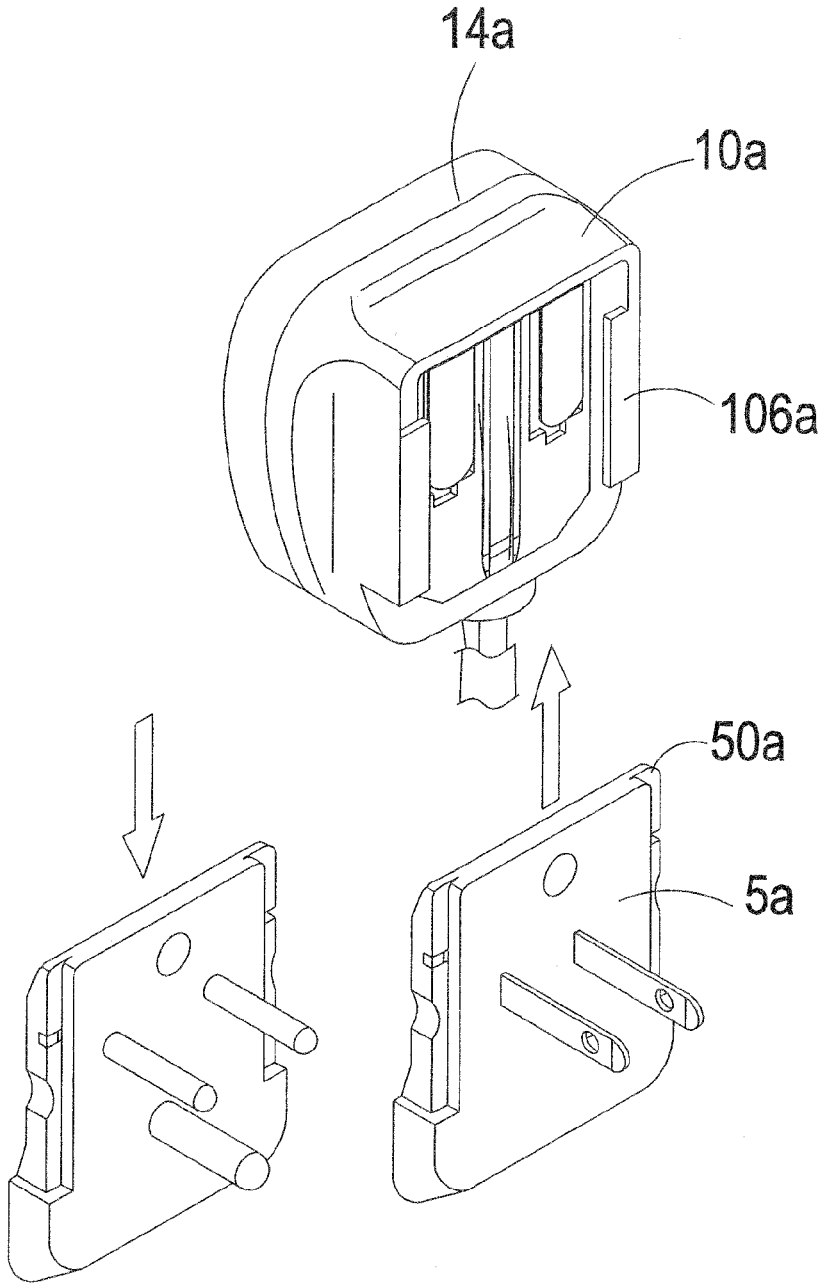
FIG. 8 is a second schematic structural view of another preferred embodiment of the present invention.

Refer to FIG. 7 and FIG. 8, which are a first schematic structural view and a second schematic structural view of another preferred embodiment of the present invention. In the figures, a panel cover 14*a* joined to a case 10*a* is shown as a blank cover by example, and thus any connection plug cannot be connected, but this still has the original advantage that the converter can be used in the form of a single converter 1*a*, conform to plug specifications of all nations in the world, and function as a plug of any electrical product. Moreover, sliding grooves 106*a* are disposed on the case 10*a* to achieve the effect that a connection guiding panel 5*a* slides through the joining of position limiting sheets 50*a* and the sliding grooves 106*a*. Therefore, manufacturers only need to store the connection guiding panel 5*a* which conforms to socket specifications of all nations in the world, and can directly replace the converter 1*a*, thus decreasing the overall storage pressure relatively.

Besides, a hole portion 142*a* is formed at a predetermined position of the panel cover 14*a*, and a screw 4*a* can be locked onto the case 10*a* through the hole portion 142*a*, so as to prevent the panel cover 14*a* from sliding, thus achieving a fixing effect.

I claim:

1. A multi-functional wiring plug converter, comprising:

a case, defining a plurality of setting areas;

a plurality of sets of connection guiding assemblies, installed on each setting area respectively so as to be fixed thereon, comprising:

a connection guiding seat, from which a blocking portion forming a plurality of fixed portions extends;

a connection guiding clamp sheet, wherein a fixed member, which is to be fixed at one of the fixed portions, is formed in a predetermined position of the connection guiding clamp sheet;

a wire-locking fixed block, wherein a connecting member joined to another fixed portion extends from the wire-locking fixed block, and the wire-locking fixed block is provided with a through hole, through which a power wire passes, and a locking hole, which communicates with the through hole and is used for screwing a locking member so as to exert a force to fix the power wire;

a panel cover, wherein the panel cover is joined to the case and forms a plurality of insertion holes, which correspond to the connection guiding clamp sheet and meet standards of all nations in the world; and a connection guiding panel, slidably disposed on a surface of the case, wherein the surface is away from the panel cover.

2. The multi-functional wiring plug converter of claim 1, wherein a plurality of sliding grooves are formed on the case.

3. The multi-functional wiring plug converter of claim 2, wherein the sliding grooves are used to join the connection guiding panel which defines position limiting sheets slidably disposed in the sliding grooves.

4. The multi-functional wiring plug converter of claim 3, wherein the connection guiding panel is configured with a plurality of connection guiding pins which conform to standards of all nations in the world.

5. The multi-functional wiring plug converter of claim 4, wherein a screw hole through which a screw passes is formed on the connection guiding panel.

6. The multi-functional wiring plug converter of claim 1, wherein a hole portion through which a screw passes to be locked onto the case is formed in a predetermined position of the panel cover.

7. The multi-functional wiring plug converter of claim 1, further comprising a wire-clamp fixed seat which is joined to the case and used to clamp the power wire.

8. The multi-functional wiring plug converter of claim 1, wherein a gripping portion, which is used to be gripped for insertion and pullout, is formed on an external wall surface of the case.

9. The multi-functional wiring plug converter of claim 1, wherein a perforation portion through which the power wire passes is formed on the case.

* * * * *